US007846543B2

(12) United States Patent
Sano et al.

(10) Patent No.: US 7,846,543 B2
(45) Date of Patent: Dec. 7, 2010

(54) PITCH-BASED CARBON FIBERS, AND MANUFACTURING METHOD AND MOLDED PRODUCT THEREOF

(75) Inventors: Hiroki Sano, Iwakuni (JP); Hiroshi Hara, Iwakuni (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 12/530,080

(22) PCT Filed: Mar. 4, 2008

(86) PCT No.: PCT/JP2008/054245

§ 371 (c)(1),
(2), (4) Date: Sep. 4, 2009

(87) PCT Pub. No.: WO2008/108482

PCT Pub. Date: Sep. 12, 2008

(65) Prior Publication Data

US 2010/0104846 A1 Apr. 29, 2010

(30) Foreign Application Priority Data

Mar. 6, 2007 (JP) ..... 2007-055924
Mar. 6, 2007 (JP) ..... 2007-055927

(51) Int. Cl.
*B32B 9/00* (2006.01)

(52) U.S. Cl. ..... 428/367; 428/408; 428/297.4; 423/447.1

(58) Field of Classification Search ..... 428/367, 428/408, 297.4; 423/447.1, 447.2
See application file for complete search history.

(56) References Cited

U.S. PATENT DOCUMENTS 4,861,653 A * 8/1989 Parrish ..... 442/349
7,651,767 B2 * 1/2010 Hirata et al. ..... 428/367
2009/0075054 A1 * 3/2009 Hirata et al. ..... 428/307.7
2009/0250655 A1 10/2009 Sano et al.
2010/0104846 A1 * 4/2010 Sano et al. ..... 428/297.4

FOREIGN PATENT DOCUMENTS

| | | | |
|---|---|---|---|
| EP | 1 186 689 | A1 | 3/2002 |
| EP | 1 873 283 | A1 | 1/2008 |
| EP | 1 876 276 | A1 | 1/2008 |
| JP | 07-085862 | A | 3/1995 |
| JP | 07-090725 | A | 4/1995 |
| JP | 11-279406 | A | 10/1999 |
| JP | 2000-192337 | A | 7/2000 |
| JP | 2002-146672 | A | 5/2002 |
| JP | 2002-535469 | A | 10/2002 |
| JP | 3648865 | B | 2/2005 |
| JP | 2005-072220 | A | 3/2005 |
| WO | 2006/112487 | A1 | 10/2006 |
| WO | 2006/112516 | A1 | 10/2006 |
| WO | 2008/013252 | A1 | 1/2008 |

* cited by examiner

*Primary Examiner*—N. Edwards
(74) *Attorney, Agent, or Firm*—Sughrue Mion, PLLC

(57) ABSTRACT

An object of the present invention is to provide carbon fibers which have a high conductivity, readily form a network in a matrix and are suitable for use in a radiating member as well as a molded product thereof. The present invention is pitch-based carbon fibers which are obtained from mesophase pitch and have an average fiber diameter (AD) of 5 to 20 μm, a ratio ($CV^{AD}$ value) of the degree of filament diameter distribution to average fiber diameter (AD) of 5 to 15, a number average fiber length (NAL) of 25 to 500 μm, a volume average fiber length (VAL) of 55 to 750 μm and a value obtained by dividing the volume average fiber length (VAL) by the number average fiber length (NAL) of 1.02 to 1.50, and a manufacturing method and molded product thereof.

15 Claims, No Drawings

PITCH-BASED CARBON FIBERS, AND MANUFACTURING METHOD AND MOLDED PRODUCT THEREOF

CROSS REFERENCE TO RELATED APPLICATION

This application is a National Stage of International Application No. PCT/JP2008/054245 filed Mar. 4, 2008, claiming priority based on Japanese Patent Application No(s). 2007-055924 and 2007-055927 filed Mar. 6, 2007, the contents of all of which are incorporated herein by reference in their entirety.

TECHNICAL FIELD

The present invention relates to pitch-based carbon fibers having a specific fiber diameter and a specific fiber length whose distributions fall within specific ranges and a manufacturing method thereof. The present invention also relates to a molded product comprising the pitch-based carbon fibers and having a high thermal conductivity.

BACKGROUND OF THE ART

High-performance carbon fibers can be classified into PAN-based carbon fibers obtained from polyacrylonitrile (PAN) and pitch-based carbon fibers obtained from pitches. Carbon fibers are widely used in aviation and space, construction and civil engineering, and sports and leisure applications, making use of their feature that they have much higher strength and elastic modulus than ordinary synthetic polymers.

The carbon fibers have a higher thermal conductivity than ordinary synthetic polymers and therefore are excellent in radiation performance. The carbon fibers attain a high thermal conductivity due to the movement of a phonon. The phonon conducts heat well in a material in which a crystal lattice is formed. It cannot be said that a crystal lattice is fully formed in commercially available PAN-based carbon fibers and their thermal conductivities are generally lower than 200 W/(m·K). It is hardly said that this is preferred from the viewpoint of thermal management. In contrast to this, a crystal lattice is fully formed in the pitch-based carbon fibers due to high graphitization and the pitch-based carbon fibers easily attain a higher thermal conductivity than the PAN-based carbon fibers.

As heat generating electronic parts are becoming higher in density and electronic equipment such as portable personal computers are becoming smaller, thinner and lighter, the requirement for the reduction of the heat resistance of radiating members used in these equipment is becoming higher and higher, and the further improvement of radiation properties is desired. The radiating members include heat conductive sheets composed of a cured product charged with a heat conductive filler, heat conductive spacers composed of a cured product having flexibility and prepared by charging a heat conductive filler into a gel-like substance, heat conductive paste having fluidity and prepared by charging a heat conductive filler into a liquid matrix, heat conductive paste having improved fluidity and prepared by diluting a heat conductive paste with a solvent, heat conductive adhesives prepared by charging a heat conductive filler into a curable substance, and phase change type radiating members making use of the phase change of a resin.

To improve the thermal conductivities of these radiating members, a heat conductive material should be charged into a matrix in a high concentration. Known heat conductive materials include metal oxides, metal nitrides, metal carbides and metal hydroxides such as aluminum oxide, boron nitride, aluminum nitride, magnesium oxide, zinc oxide, silicon carbide, quartz and aluminum hydroxide (Patent Document 1). However, metal-based heat conductive materials have high specific gravity and increase the weight of a radiating member. When a powdery heat conductive material is used, a network is hardly formed, thereby making it difficult to obtain a high thermal conductivity. Therefore, to improve thermal conductivity, a large amount of a heat conductive material must be used with the result that the weight and cost of a radiating member increase and it is hardly said that a heat conductive material is always convenient.

Therefore, to make effective use of the high thermal conductivity of a heat conductive material, it is preferred that the heat conductive material should form a network while a suitable matrix is existent therein. As for the shape of a heat conductive material for forming a network easily, a fibrous material is widely known (Patent Document 2).

An example of the fibrous material is a carbon fiber. The carbon fiber is used in carbon fiber reinforced plastics due to its stiffness and heat resistance (Patent Document 3). Also the use of the carbon fiber in secondary cell electrodes is proposed (Patent Document 4).

It is also proposed to use the carbon fiber in a heat conductive material. For example, Patent Document 5 proposes a radiating sheet comprising graphitic carbon fibers having an average fiber length of not less than 30 μm and less than 300 μm. Patent Document 6 proposes a heat conducting apparatus made of a composition comprising carbon fibers having a length of 10 to 150 μm. Patent Document 7 proposes a semiconductor device containing graphitic carbon fibers covered with a ferromagnetic material. However, Patent Documents 5 to 7 do not take into consideration the improvement of the dispensability of the carbon fibers in a matrix and there is room to improve the network forming capability of the carbon fibers to improve thermal conductivity.

(Patent Document 1) JP-A 2005-72220
(Patent Document 2) JP-A 2002-535469
(Patent Document 3) JP-A 7-90725
(Patent Document 4) JP-A 7-85862
(Patent Document 5) JP-A 2000-192337
(Patent Document 6) JP-A 11-279406
(Patent Document 7) JP-A 2002-146672

DISCLOSURE OF THE INVENTION

It is an object of the present invention to provide carbon fibers which have an excellent thermal conductivity and are suitable for use in a radiating member. It is another object of the present invention to provide carbon fibers which have a high thermal conductivity and readily form a network in a matrix. It is still another object of the present invention to provide a method of manufacturing the carbon fibers. It is a further object of the present invention to provide a molded product having a high thermal conductivity in which a carbon fiber network is formed in a matrix at a high density.

It is desired that the carbon fibers for use in a radiating member should readily form a network in a matrix and have a high thermal conductivity at the same time. The inventors of the present invention searched for carbon fibers which are excellent in thermal conductivity and network forming capability. As a result, they found that when pitch-based carbon fibers having a large crystal size are used in a radiating member containing carbon fibers and a matrix, the thermal conductivity of the radiating member is improved. They also found that when the fiber length in the radiating member is set to a specific range and a fiber length distribution is suppressed and made uniform as much as possible, a carbon fiber network is readily formed and thermal conductivity is improved. They also found that when the fiber diameter in the radiating member is set to a specific range and the fiber diameter distribution is set to a specific range, thermal conductivity is further improved. The present invention is based on these findings.

That is, the present invention is pitch-based carbon fibers which are obtained from mesophase pitch and have an average fiber diameter (AD) of 5 to 20 μm, a percentage ($CV^{AD}$ value) of the degree of filament diameter distribution to average fiber diameter (AD) of 5 to 15, a number average fiber length (NAL) of 25 to 500 μm, a volume average fiber length (VAL) of 55 to 750 μm and a value obtained by dividing the volume average fiber length (VAL) by the number average fiber length (NAL) of 1.02 to 1.50.

The present invention also includes a molded product comprising the above carbon fibers.

Further, the present invention is a method of manufacturing pitch-based carbon fibers by spinning molten mesophase pitch by a melt blow method, and stabilizing, baking and milling it, wherein the viscosity of the molten mesophase pitch at the time of spinning is 5 to 25 Pa·s.

Further, the present invention is a method of improving the thermal conductivity of a radiating member comprising carbon fibers and a matrix, wherein pitch-based carbon fibers obtained from mesophase pitch and having an average fiber diameter (AD) of 5 to 20 μm, a percentage ($CV^{AD}$ value) of the degree of filament diameter distribution to average fiber diameter (AD) of 5 to 15, a number average fiber length (NAL) of 25 to 500 μm, a volume average fiber length (VAL) of 55 to 750 μm and a value obtained by dividing the volume average fiber length (VAL) by the number average fiber length (NAL) of 1.02 to 1.50 are used as the carbon fibers.

BEST MODE FOR CARRYING OUT THE INVENTION

Embodiments of the present invention will be described hereinunder.

<Pitch-Based Carbon Fibers>

(Average Fiber Lengths: NAL, VAL)

The carbon fibers of the present invention have a number average fiber length (NAL) of 25 to 500 μm, a volume average fiber length (VAL) of 55 to 750 μm, and a (VAL/NAL) value obtained by dividing the volume average fiber length (VAL) by the number average fiber length (NAL) of 1.02 to 1.50.

The number average fiber length (NAL) is preferably 50 to 500 μm, more preferably 100 to 500 μm, much more preferably 100 to 400 μm.

The volume average fiber length (VAL) is preferably 60 to 750 μm, more preferably 100 to 600 μm.

VAL/NAL is preferably 1.1 to 1.4, more preferably 1.15 to 1.35.

When the number average fiber length (NAL) is smaller than 25 μm or the volume average fiber length (VAL) is smaller than 55 μm, a network of the carbon fibers cannot be formed fully in a matrix, thereby making it impossible to obtain a high thermal conductivity. When the number average fiber length (NAL) is larger than 500 μm or the volume average fiber length (VAL) is larger than 750 μm, the interlacing of the fibers greatly increases and the viscosity of a mixture of the fibers and a resin becomes high, thereby making it difficult to handle it.

The (VAL/NAL) value obtained by dividing the volume average fiber length (VAL) by the number average fiber length (NAL) means the broadness of the fiber length distribution of the carbon fibers. When this value is smaller than 1.02, almost all the carbon fibers have the same fiber length, which is substantially impossible. When the value is larger than 1.50, the fiber length distribution is very broad, which means that carbon fibers having a extremely small fiber length or an extremely large fiber length are included, resulting in the reduction of thermal conductivity or the increase of viscosity.

The average fiber length can be controlled by milling conditions. That is, the average fiber length can be controlled by adjusting the number of revolutions of a cutter when they are milled with a cutter, the number of revolutions of a ball mill, the air flow rate of a jet mill, the number of collisions of a crusher and the residence time in a milling machine. Alternatively, it can be controlled by classifying the milled carbon fibers with a sieve to remove carbon fibers having a small fiber length or a large fiber length.

(Ratio of Carbon Fibers Remaining on a Sieve)

It is desired that the pitch-based carbon fibers of the present invention should have a number average fiber length (NAL) of 100 to 500 μm, a ratio of carbon fibers remaining on a mesh sieve having an opening size of 53 μm when classified with the sieve of 30 to 60% and a ratio of carbon fibers remaining on a mesh sieve having an opening size of 100 μm when classified with the sieve of 10 to 29%. Carbon fibers remaining on the mesh sieve having an opening size of 53 μm advantageously form a matrix to function effectively for thermal conduction. As carbon fibers remaining on the mesh sieve having an opening size of 100 μm have high bulk density, they are interlaced with one another in the matrix to form spaces. Short carbon fibers remaining under the mesh sieve having an opening size of 53 μm enter these spaces, whereby the filled state of the carbon fibers in the matrix becomes preferred. What advantageously satisfies this condition is that the ratio of carbon fibers remaining on a mesh sieve having an opening size of 53 μm when classified with the sieve is 30 to 60% and the ratio of carbon fibers remaining on a mesh sieve having an opening size of 100 μm when classified with the sieve is 10 to 29%. The ratio of carbon fibers remaining on the sieve can be controlled by adjusting milling conditions and classification conditions.

As a specific control method, pitch-based carbon fiber fillers having a small fiber length or a large fiber length are removed by using a sieve or mesh after milling. A fiber length distribution can be controlled by adjusting milling strength such as the number of revolutions of the blade of a cutter, the number of revolutions of a ball mill, the air flow rate of a jet mill, the number of collisions of a crusher and the residence time in a milling machine, and the ratio of carbon fibers remaining on the sieve can be accurately controlled by combing this with control with the sieve or mesh.

(Average Fiber Diameter: AD)

The average fiber diameter (AD) of the carbon fibers is 5 to 20 μm. When the average fiber diameter is smaller than 5 μm, the number of fillers to be compounded with the matrix becomes large, whereby the viscosity of a mixture of the matrix and the fillers becomes high, thereby making molding difficult. When the average fiber diameter is larger than 20 μm, the number of fillers to be compounded with the matrix becomes small with the result that the fillers hardly contact one another and the obtained composite material hardly conducts heat effectively. The average fiber diameter (AD) is preferably 5 to 15 μm, more preferably 7 to 13 μm.

The $CV^{AD}$ value obtained as the percentage of the degree of filament diameter distribution to average fiber diameter (AD) is 5 to 15.

The $CV^{AD}$ value can be obtained from the following equation.

$$CV^{AD}=S/AD \quad (1)$$

wherein S is the degree of filament diameter distribution and AD is an average fiber diameter.

S is obtained from the following equation (2).

$$S=\sqrt{\frac{\sum(D-AD)^2}{n}} \quad (2)$$

wherein D is the fiber diameter of each fiber and n is the number of the measured fibers.

As the $CV^{AD}$ value becomes smaller, the process stability becomes higher and product variations become smaller. When the $CV^{AD}$ value is smaller than 5, the fillers are uniform in fiber diameter, whereby fillers having a small fiber diameter hardly enter between fillers and it is difficult to add a large amount of the fillers to be compounded with the matrix with the result that a high-performance composite material is hardly obtained. When the $CV^{AD}$ value is larger than 15 and the fillers are compounded with the matrix, the viscosity is apt to vary and the dispersibility degrades. As a result, the dispersion of the fillers in the composite material becomes not uniform and a uniform thermal conductivity cannot be obtained. The above $CV^{AD}$ value can be obtained by adjusting the viscosity of molten mesophase pitch at the time of spinning, specifically, adjusting the viscosity of the molten pitch to 5 to 25 Pa·s at the time of spinning by a melt blow method.

(Size of Crystallite)

The carbon fibers of the present invention preferably have a crystallite size derived from the hexagonal net plane growth direction of not less than 5 nm. The size of the crystallite derived from the growth direction of the hexagonal net plane can be obtained by a known method, that is, from a diffraction line from the (110) face of a carbon crystal obtained by an X-ray diffraction method. The reason that the size of the crystallite is important is that mainly a phonon conducts heat and a crystal forms the phonon. The size of the crystallize is more preferably not less than 20 nm, more preferably not less than 30 nm. The upper limit of the size of the crystallite is about 100 nm.

(True Density)

The true density of the carbon fibers is preferably 1.5 to 2.3 g/cc, more preferably 1.8 to 2.3 g/cc, much more preferably 2.1 to 2.3 g/cc. When the true density falls within this range, the graphitization degree increases fully, a satisfactory thermal conductivity can be obtained, and the energy cost for graphitization becomes appropriate for the characteristic properties of the obtained carbon fibers.

(Thermal Conductivity)

The thermal conductivity in the fiber axis direction of the carbon fiber is preferably not less than 300 W/m·K, more preferably 600 to 1,100 W/m·K or more. When the thermal conductivity is higher than 300 W/m·K and the carbon fibers are mixed with the matrix to manufacture a molded product, a sufficiently high thermal conductivity can be obtained.

<Method of Manufacturing Pitch-Based Carbon Fibers>

The pitch-based carbon fibers of the present invention can be manufactured by spinning molten mesophase pitch by a melt blow method and stabilizing, baking and milling and optionally sieving it. After milling, it is preferably graphitized.

(Raw Material)

Examples of the raw material of the pitch-based carbon fibers of the present invention include condensation polycyclic hydrocarbon compounds such as naphthalene and phenanthrene, and condensation heterocyclic compounds such as petroleum-based pitch and coal-based pitch. Out of these, condensation polycyclic hydrocarbon compounds such as naphthalene and phenanthrene are preferred. Optically anisotropic pitch, that is, mesophase pitch is particularly preferred. They may be used alone or in combination of two or more. It is particularly preferred to use mesophase pitch alone because it improves the thermal conductivity of the carbon fibers.

The softening point of the raw material pitch can be obtained by a Mettler method and is preferably 250 to 350° C. When the softening point is lower than 250° C., fusion bonding between fibers or large thermal shrinkage occurs during stabilization. When the softening point is higher than 350° C., the temperature suitable for spinning becomes high, whereby the thermal decomposition of the pitch tends to occur, thereby making spinning difficult.

(Spinning)

The raw material pitch can be changed into fibers by melt spinning in which the pitch is delivered from a nozzle and cooled after it is molten. Although the spinning method is not particularly limited, it may be a normal spinning method in which pitch delivered from the nozzle is taken up by a winder, a melt blow method in which hot air is used as an atomizing source, or a centrifugal spinning method in which pitch is taken up by making use of centrifugal force. Out of these, the melt blow method is preferably used because it has high productivity.

The raw material pitch is preferably graphitized in the end after it is melt spun, stabilized, baked and milled. Each step of the melt blow method as an example of the spinning method will be described hereinbelow.

Although a spinning nozzle for the pitch fibers which are the raw material of the pitch-based carbon fibers is not limited to a particular shape in the present invention, a spinning nozzle having an introduction angle $\alpha$ of 10 to 90° and an L/D ratio of the discharge port length L to the discharge port diameter D of 6 to 20 is preferably used. The temperature of the nozzle at the time of spinning may be a temperature at which a stable spinning state can be maintained. To reduce nonuniformity in fiber diameter, that is, set the $CV^{AD}$ value to a predetermined range, the viscosity of the molten pitch at the time of spinning is preferably 5 to 25 Pa·s, more preferably 6 to 22 Pa·s. Although the temperature dependence of the viscosity of the molten pitch differs according to the composition of the raw material pitch, that is, the content of a volatile component, when the temperature of the molten pitch is adjusted to a temperature 40 to 60° C. higher than the softening point, this viscosity can be achieved in most cases. When the spinning condition falls within this range, shear force applied to the raw material pitch can align aromatic rings to a certain extent. When the spinning condition is outside of this, for example, shear force is stronger, such as, the viscosity is lower than the above lower limit, the introduction angle is smaller than the lower limit, or the L/D is larger than the upper limit, the alignment proceeds too far, whereby the carbon fibers readily crack at the time of graphitization. When shear force is smaller, such as the viscosity is larger than the upper limit, the introduction angle is larger than the upper limit or the L/D is smaller than the lower limit, the aromatic rings do not align so much, whereby the degree of graphitization is not improved so much by graphitization and a high thermal conductivity cannot be obtained.

The pitch fibers spun from the nozzle hole are changed into short fibers by blowing a gas having a linear velocity of 100 to 10,000 m/min and heated at 100 to 350° C. to a position near a thinning point. As the temperature of the gas becomes higher, the time elapsed before the pitch is solidified becomes longer, a stretching effect is obtained for a longer time, and therefore, finer fibers are apt to be obtained. It is preferred to blow a gas heated at a temperature close to the melting point of the raw material pitch. Similarly, as the linear velocity of the gas to be blown is higher, a stronger stretching effect is obtained, and finer fibers are apt to be obtained. When the linear velocity of the gas is too high, the pitch fibers are broken and a loss on a metal net belt which will be described hereinafter becomes large. The preferred linear velocity which differs according to melt viscosity at the time of spinning is preferably 3,000 to 7,000 m/min when the melt viscosity is 100 Pa·s. The gas to be blown is, for example, air, nitrogen or argon, preferably air from the viewpoint of cost performance.

The pitch fibers are captured on a metal net belt to become a continuous web form which is then crosslapped to become a 3-D random web.

The 3-D random web is a web which is produced by crosslapping the pitch fibers and interlacing them 3-dimensionally. This interlacing is accomplished in a cylinder called "chimney" while the pitch fibers reach the metal net belt from the nozzle. Since the linear fibers are interlaced 3-dimensionally, the characteristic properties of the fibers which show only one-dimensional behavior are reflected even in a 3-D space.

(Stabilization)

The 3-D random web composed of the pitch fibers obtained as described above is stabilized by a known method. Stabilization is carried out at 200 to 350° C. by using air or a gas obtained by adding ozone, nitrogen dioxide, nitrogen, oxygen, iodine or bromine to air. It is preferably carried out in the air when safety and convenience are taken into consideration.

(Baking)

The stabilized pitch fibers are baked in vacuum or an inert gas such as nitrogen, argon or krypton at 600 to 1,500° C. They are baked under normal pressure in inexpensive nitrogen in most cases.

(Milling)

After stabilization or baking, pitch-based carbon fibers can be obtained by milling the fibers. Milling can be carried out by a known method. Specifically, a cutter, ball mill, jet mill or crusher may be used.

(Classification)

The carbon fibers are preferably classified with a sieve to remove carbon fibers having a large fiber length or a small fiber length. The opening size of the sieve for removing long carbon fibers is about 0.8 to 1 mm and the opening size of the sieve for removing short carbon fibers is about 20 μm. Although short or long carbon fibers can be removed by repeating classification many times, this effect is large even by carrying out classification only once.

This classification step may be carried out after milling or graphitization but a grinder and a classifier can be easy combined together and classification can be carried out efficiently after milling advantageously.

(Graphitization)

The milled pitch-based carbon fibers are classified as required and then preferably graphitized. The graphitization temperature is preferably 2,000 to 3,500° C. to increase the thermal conductivity of the carbon fibers. It is more preferably 2,300 to 3,100° C. It is much more preferably 2,800 to 3,100° C. They are preferably put into a graphite crucible for graphitization because a physical or chemical function from the outside can be shut off. The graphite crucible is not limited to a particular size or shape if it can contain a predetermined amount of the above carbon fibers but a covered crucible having high airtightness is preferably used to prevent the carbon fibers from being damaged by a reaction with an oxidizing gas or steam in a furnace during graphitization or cooling. Graphitization is generally carried out by changing the type of the inert gas according to the type of the furnace in use.

(Molded Product)

The carbon fibers of the present invention are compounded with a matrix to obtain a molded product such as a compound, sheet, grease or adhesive. Therefore, the present invention includes a molded product comprising the carbon fibers.

The molded product contains the carbon fibers and the matrix, and the content of the carbon fibers is preferably 10 to 70 parts by weight, more preferably 20 to 60 parts by weight based on 100 parts by weight of the molded product. Examples of the matrix include polyolefin-based resins, polyester-based resins, polycarbonate-based resins, polyamide-based resins, polyimide-based resins, polyphenylene sulfide-based resins, polysulfone-based resins, polyether sulfone-based resins, polyether ketone-based resins, polyether ether ketone-based resins, epoxy-based resins, acrylic resins, phenol-based resins and silicone-based resins. The molded product is suitable for use as a radiating member for heat generating electronic parts.

<Method of Improving Thermal Conductivity>

The present invention is a method of improving the thermal conductivity of a radiating member containing carbon fibers and a matrix and includes a method in which pitch-based carbon fibers obtained from mesophase pitch and having an average fiber diameter (AD) of 5 to 20 μm, a percentage ($CV^{AD}$ value) of the degree of filament diameter distribution to average fiber diameter (AD) of 5 to 15, a number average fiber length (NAL) of 25 to 500 μm, a volume average fiber length (VAL) of 55 to 750 μm and a value obtained by dividing the volume average fiber length (VAL) by the number average fiber length (NAL) of 1.02 to 1.50 are used as the carbon fibers.

The carbon fibers and the matrix are as described above. The content of the carbon fibers in the radiating member is preferably 10 to 70 parts by weight, more preferably 20 to 60 parts by weight based on 100 parts by weight of the radiating member.

EXAMPLES

Examples are provided hereinafter but are in no way to be taken as limiting. Values in the examples were obtained by the following methods.

(1) The average fiber diameter (AD) of the carbon fibers is the average value of 60 baked carbon fibers measured by using a scale under an optical microscope.

(2) The number average fiber length (NAL) of the carbon fibers is the average value of 1,000 baked carbon fibers measured with an end-measuring machine. The volume average fiber length (VAL) was obtained as the square root of the average value of squares of the fiber lengths of 1,000 actually measured fibers.

(3) The size of the crystallite of each carbon fiber was obtained by measuring reflection from the (110) face which appeared in X-ray diffraction in accordance with the GAKUSHIN method.

(4) The density of the carbon fibers was determined based on the sedimentation of the carbon fibers by injecting the carbon fibers into a mixed solution whose density was controlled by adjusting the mixing ratio of bromoform (density of 2.90 g/cc) and 1,1,2,2-tetrachloroethane (density of 1.59 g/cc).

(5) The thermal conductivity of the carbon fiber was calculated from the following relational expression (refer to U.S. Pat. No. 3,648,865) between thermal conductivity and electric resistance obtained from the radii of the carbon fibers by fixing 20 graphitized pitch-based carbon fibers manufactured under the same condition except for the milling step with silver paste to ensure that the distances between their both ends became 1 cm and measuring the electric resistances of the both ends with a tester.

$$K=1272.4/ER-49.4$$

(K is the thermal conductivity W/(m·K) of each carbon fiber, and ER is the electric resistivity μΩm of the carbon fiber)

(6) The thermal conductivity of a carbon fiber/silicone composite material was obtained by a probe method using the QTM-500 of Kyoto Electronics Manufacturing Co., Ltd.

(7) The ratio of pitch-based carbon fiber fillers remaining on a mesh was obtained by measuring the mass of the obtained carbon fibers after 100 g of the carbon fibers were sieved out with mesh shakers having an opening size of 100 μm and an opening size of 53 μm (R-1 of TANAKA TEC CORPORATION).

Example 1

Pitch composed of a condensation polycyclic hydrocarbon compound was used as the main raw material. The ratio of the optical anisotropy of this pitch was 100% and the softening point was 283° C. A cap having a hole with a diameter of 0.2 mm was used, and heated air was ejected from a slit at a linear velocity of 5,500 m/min to draw the molten pitch so as to manufacture pitch-based short fibers having an average diameter of 14.5 μm. The resin temperature at this point was 337° C., and the melt viscosity was 8.0 Pa·s. The spun fibers were collected on a belt to obtain a web which was then cross-lapped to manufacture a 3-D random web composed of pitch-based short fibers having a weight of 320 g/m$^2$.

This 3-D random web was heated in the air from 170 to 285° C. at an average temperature elevation rate of 6° C./min to be stabilized. The stabilized 3-D random web was milled with a cutter (manufactured by Turbo Kogyo Co., Ltd.) at 800 rpm, classified with a sieve having an opening size of 1 mm and baked at 3,000° C.

The baked carbon fibers had an average fiber diameter (AD) of 8.8 μm and a percentage (CV value) of the degree of filament diameter distribution to average fiber diameter (AD) of 12%.

The number average fiber length (NAL) was 200 μm, the volume average fiber length (VAL) was 240 μm, the value obtained by dividing the volume average fiber length (VAL) by the number average fiber length (NAL) was 1.20, the ratio of carbon fibers remaining on a mesh sieve having an opening size of 53 μm when classified with the sieve was 45%, and the ratio of carbon fibers remaining on a mesh sieve having an opening size of 100 μm when classified with the sieve was 24%. The size of the crystallite derived from the growth direction of the hexagonal net plane was 70 nm. The true density was 2.18 g/cc, and the thermal conductivity was 350 W/m·K.

25 parts by weight of the obtained carbon fibers and 75 parts by weight of silicone resin (SE1740 of Dow Corning Toray Co., Ltd.) were mixed together and thermally cured at 130° C. to obtain a carbon fiber/silicone composite material. When the thermal conductivity of the obtained carbon fiber/silicone composite material was measured, it was 6.3 W/(m·K).

Example 2

Carbon fibers were manufactured in the same manner as in Example 1 except that the number of revolutions of the cutter was changed to 700 rpm.

The baked carbon fibers had an average fiber diameter (AD) of 8.6 μm and a percentage (CV value) of the degree of filament diameter distribution to average fiber diameter (AD) of 12%. The number average fiber length (NAL) was 300 μm, the volume average fiber length (VAL) was 390 μm, the value obtained by dividing the volume average fiber length (VAL) by the number average fiber length (NAL) was 1.30, the ratio of carbon fibers remaining on a mesh sieve having an opening size of 53 μm when classified with the sieve was 55%, and the ratio of carbon fibers remaining on a mesh sieve having an opening size of 100 μm when classified with the sieve was 29%. The size of the crystallite derived from the growth direction of the hexagonal net plane was 70 nm. The true density was 2.18 g/cc and the thermal conductivity was 350 W/m·K.

25 parts by weight of the obtained carbon fibers and 75 parts by weight of silicone resin (SE1740 of Dow Corning Toray Co., Ltd.) were mixed together and thermally cured at 130° C. to obtain a carbon fiber/silicone composite material. When the thermal conductivity of the obtained carbon fiber/silicone composite material was measured, it was 6.6 W/(m·K).

Comparative Example 1

Carbon fibers were manufactured in the same manner as in Example 1 except that classification with a sieve was not carried out.

The baked carbon fibers had an average fiber diameter (AD) of 8.8 μm and a percentage (CV value) of the degree of filament diameter distribution to average fiber diameter (AD) of 12%. The number average fiber length (NAL) was 250 μm, the volume average fiber length (VAL) was 400 μm, the value obtained by dividing the volume average fiber length (VAL) by the number average fiber length (NAL) was 1.60, the ratio of carbon fibers remaining on a mesh sieve having an opening size of 53 μm when classified with the sieve was 62%, and the ratio of carbon fibers remaining on a mesh sieve having an opening size of 100 μm when classified with the sieve was 33%. The size of the crystallite derived from the growth direction of the hexagonal net plane was 70 nm. The true density was 2.19 g/cc and the thermal conductivity was 350 W/m·K.

25 parts by weight of the obtained carbon fibers and 75 parts by weight of silicone resin (SE1740 of Dow Corning Toray Co., Ltd.) were mixed together and thermally cured at 130° C. to obtain a carbon fiber/silicone composite material. When the thermal conductivity of the obtained carbon fiber/silicone composite material was measured, it was 3.3 W/(m·K).

Comparative Example 2

Carbon fibers were manufactured in the same manner as in Example 1 except that the number of revolutions of the cutter was changed to 1,200 rpm.

The baked carbon fibers had an average fiber diameter (AD) of 8.8 μm and a percentage (CV value) of the degree of filament diameter distribution to average fiber diameter (AD) of 13%. The number average fiber length (NAL) was 40 μm, the volume average fiber length (VAL) was 50 μm, the value obtained by dividing the volume average fiber length (VAL) by the number average fiber length (NAL) was 1.13, the ratio of carbon fibers remaining on a mesh sieve having an opening size of 53 μm when classified with the sieve was 18%, and the ratio of carbon fibers remaining on a mesh sieve having an opening size of 100 μm when classified with the sieve was 3%. The size of the crystallite derived from the growth direction of the hexagonal net plane was 70 nm. The true density was 2.18 g/cc and the thermal conductivity was 350 W/m·K.

25 parts by weight of the obtained carbon fibers and 75 parts by weight of silicone resin (SE1740 of Dow Corning Toray Co., Ltd.) were mixed together and thermally cured at 130° C. to obtain a carbon fiber/silicone composite material. When the thermal conductivity of the obtained carbon fiber/silicone composite material was measured, it was 1.4 W/(m·K).

Comparative Example 3

Carbon fibers were manufactured in the same manner as in Example 1 except that the number of revolutions of the cutter was changed to 400 rpm.

The baked carbon fibers had an average fiber diameter (AD) of 8.8 μm and a percentage (CV value) of the degree of filament diameter distribution to average fiber diameter (AD) of 12%. The number average fiber length (NAL) was 600 μm, the volume average fiber length (VAL) was 700 μm, the value obtained by dividing the volume average fiber length (VAL) by the number average fiber length (NAL) was 1.17, the ratio of carbon fibers remaining on a mesh sieve having an opening size of 53 μm when classified with the sieve was 87%, and the ratio of carbon fibers remaining on a mesh sieve having an opening size of 100 μm when classified with the sieve was 59%. The size of the crystallite derived from the growth direction of the hexagonal net plane was 70 nm. The true density was 2.18 g/cc and the thermal conductivity was 350 W/m·K.

When 25 parts by weight of the obtained carbon fibers and 75 parts by weight of silicone resin (SE1740 of Dow Corning Toray Co., Ltd.) were mixed together, the viscosity of the mixture was high and a similar sheet to that of Example 1 could not be manufactured.

Comparative Example 4

Carbon fibers were manufactured in the same manner as in Example 1 except that the resin temperature was changed to 345° C. and the melt viscosity was changed to 2.0 Pa·s.

The baked carbon fibers had an average fiber diameter (AD) of 8.4 μm and a percentage (CV value) of the degree of filament diameter distribution to average fiber diameter (AD) of 19%. The number average fiber length (NAL) was 180 μm, the volume average fiber length (VAL) was 240 μm, the value obtained by dividing the volume average fiber length (VAL) by the number average fiber length (NAL) was 1.33, the ratio of carbon fibers remaining on a mesh sieve having an opening size of 53 μm when classified with the sieve was 49%, and the ratio of carbon fibers remaining on a mesh sieve having an opening size of 100 μm when classified with the sieve was 23%. The size of the crystallite derived from the growth direction of the hexagonal net plane was 70 nm. The true density was 2.18 g/cc and the thermal conductivity was 350 W/m·K.

Although a carbon fiber/silicone composite material was obtained by mixing together 25 parts by weight of the obtained carbon fibers and 75 parts by weight of silicone resin (SE1740 of Dow Corning Toray Co., Ltd.) and thermally curing the mixture at 130° C., the carbon fibers were not uniformly dispersed and a nonuniform molded product was obtained.

Comparative Example 5

Carbon fibers were manufactured in the same manner as in Example 1 except that the step of baking at 3,000° C. was carried out before milling.

The baked carbon fibers had an average fiber diameter (AD) of 8.1 μm and a percentage (CV value) of the degree of filament diameter distribution to average fiber diameter (AD) of 18%. The number average fiber length (NAL) was 210 μm, the volume average fiber length (VAL) was 300 μm, the value obtained by dividing the volume average fiber length (VAL) by the number average fiber length (NAL) was 1.43, the ratio of carbon fibers remaining on a mesh sieve having an opening size of 53 μm when classified with the sieve was 48%, and the ratio of carbon fibers remaining on a mesh sieve having an opening size of 100 μm when classified with the sieve was 26%. The size of the crystallite derived from the growth direction of the hexagonal net plane was 70 nm. The true density was 2.18 g/cc and the thermal conductivity was 350 W/m·K.

Although a carbon fiber/silicone composite material was obtained by mixing together 25 parts by weight of the obtained carbon fibers and 75 parts by weight of silicone resin (SE1740 of Dow Corning Toray Co., Ltd.) and thermally curing the mixture at 130° C., the viscosity of the mixture was high and a similar sheet to that of Example 1 could not be manufactured.

The results of Examples 1 and 2 and Comparative Examples 1 to 5 are shown in Table 1 and Table 2.

TABLE 1

| Item | Unit | Ex. 1 | Ex. 2 | C. Ex. 1 | C. Ex. 2 | C. Ex. 3 | C. Ex. 4 | C. Ex. 5 |
|---|---|---|---|---|---|---|---|---|
| AD | μm | 8.8 | 8.6 | 8.8 | 8.8 | 8.8 | 8.4 | 8.1 |
| $CV^{AD}$ value | % | 12 | 12 | 12 | 13 | 12 | 19 | 18 |
| NAL | μm | 200 | 300 | 250 | 40 | 600 | 180 | 210 |
| VAL | μm | 240 | 390 | 400 | 50 | 700 | 240 | 300 |

TABLE 1-continued

| Item | Unit | Ex. 1 | Ex. 2 | C. Ex. 1 | C. Ex. 2 | C. Ex. 3 | C. Ex. 4 | C. Ex. 5 |
|---|---|---|---|---|---|---|---|---|
| VAL/NAL | — | 1.20 | 1.30 | 1.60 | 1.13 | 1.17 | 1.33 | 1.43 |
| Crystallite size | nm | 70 | 70 | 70 | 70 | 70 | 70 | 70 |
| True density | g/cc | 2.18 | 2.18 | 2.19 | 2.18 | 2.18 | 2.18 | 2.18 |
| Thermal conductivity | W/m · K | 350 | 350 | 350 | 350 | 350 | 350 | 350 |
| Number of revolutions | rpm | 800 | 700 | 800 | 1200 | 400 | 800 | 800 |
| Classification | — | done | done | not done | done | done | done | done |
| On a sieve having an opening size of 53 μm | % | 45 | 55 | 62 | 18 | 87 | 49 | 48 |
| On a sieve having an opening size of 100 μm | % | 24 | 29 | 33 | 3 | 59 | 23 | 26 |

AD: average fiber diameter,
NAL: number average fiber length,
VAL: volume average fiber length

TABLE 2

| Item | Unit | Ex. 1 | Ex. 2 | C. Ex. 1 | C. Ex. 2 | C. Ex. 3 | C. Ex. 4 | C. Ex. 5 |
|---|---|---|---|---|---|---|---|---|
| Carbon fibers | parts by weight | 25 | 25 | 25 | 25 | 25 | 25 | 25 |
| Silicone resin | parts by weight | 75 | 75 | 75 | 75 | 75 | 75 | 75 |
| Thermal conductivity | W/(m · K) | 6.3 | 6.6 | 3.3 | 1.4 | — | — | — |

Ex.: Example
C. Ex.: Comparative Example

Example 3

Pitch composed of a condensation polycyclic hydrocarbon compound was used as the main raw material. The ratio of the optical anisotropy of this pitch was 100% and the softening point was 283° C. A cap having a hole with a diameter of 0.2 mm was used, and heated air was ejected from a slit at a linear velocity of 5,500 m/min to draw the molten pitch so as to manufacture pitch-based short fibers having an average diameter of 14.5 μm. The resin temperature at this point was 337° C., and the melt viscosity was 8.0 Pa·s. The spun fibers were collected on a belt to form a web which was then crosslapped to manufacture a 3-D random web composed of pitch-based short fibers having a weight of 320 g/m$^2$.

This 3-D random web was heated in the air from 170 to 285° C. at an average temperature elevation rate of 6° C./min to be stabilized. The stabilized 3-D random web was milled with a cutter (manufactured by Turbo Kogyo Co., Ltd.) at 800 rpm, classified with a sieve having an opening size of 1 mm and baked at 3,000° C. The baked pitch-based carbon fiber fillers had an average fiber diameter (AD) of 8.8 μm and a percentage (CV value) of the degree of filament diameter distribution to average fiber diameter (AD) of 12. The number average fiber length (NAL) was 200 μm, the ratio of carbon fibers remaining on a mesh sieve having an opening size of 53 μm when classified with the sieve was 45%, and the ratio of carbon fibers remaining on a mesh sieve having an opening size of 100 μm when classified with the sieve was 24%. The size of the crystallite derived from the growth direction of the hexagonal net plane was 70 nm. The true density was 2.18 g/cc, and the thermal conductivity was 350 W/m·K.

25 parts by weight of the obtained carbon fibers and 75 parts by weight of silicone resin (SE1740 of Dow Corning Toray Co., Ltd.) were mixed together and thermally cured at 130° C. to obtain a carbon fiber/silicone composite material. When the thermal conductivity of the obtained carbon fiber/silicone composite material was measured, it was 5.6 W/(m·K).

Example 4

Pitch-based carbon fiber fillers were manufactured in the same manner as in Example 1 except that the number of revolutions of the cutter was changed to 900 rpm. The baked pitch-based carbon fiber fillers had an average fiber diameter (AD) of 8.8 μm and a percentage (CV value) of the degree of filament diameter distribution to average fiber diameter (AD) of 12. The number average fiber length (NAL) was 160 μm, the ratio of carbon fibers remaining on a mesh sieve having an opening size of 53 μm when classified with the sieve was 35%, and the ratio of carbon fibers remaining on a mesh sieve having an opening size of 100 μm when classified with the sieve was 20%. The size of the crystallite derived from the growth direction of the hexagonal net plane was 70 nm. The true density was 2.18 g/cc and the thermal conductivity was 350 W/m·K.

A carbon fiber/silicone composite material was obtained by mixing together 25 parts by weight of the obtained carbon fibers and 75 parts by weight of silicone resin (SE1740 of Dow Corning Toray Co., Ltd.) and thermally curing the mixture at 130° C. When the thermal conductivity of the obtained carbon fiber/silicone composite material was measured, it was 4.8 W/(m·K).

The results of Examples 3 and 4 are shown in Tables 3 and 4.

TABLE 3

| Item | Unit | Example 3 | Example 4 |
|---|---|---|---|
| AD | μm | 8.8 | 8.8 |
| $CV^{AD}$ value | % | 12 | 12 |

TABLE 3-continued

| Item | Unit | Example 3 | Example 4 |
|---|---|---|---|
| NAL | μm | 200 | 160 |
| VAL | μm | 240 | 190 |
| VAL/NAL | — | 1.20 | 1.19 |
| Crystallite size | nm | 70 | 70 |
| True density | g/cc | 2.18 | 2.18 |
| Thermal conductivity | W/m · K | 350 | 350 |
| Number of revolutions | rpm | 800 | 900 |
| Classification | — | done | done |
| On a sieve having an opening size of 53 μm | % | 45 | 35 |
| On a sieve having an opening size of 100 μm | % | 24 | 20 |

AD: average fiber diameter,
NAL: number average fiber length,
VAL: volume average fiber length

TABLE 4

| Item | Unit | Example 3 | Example 4 |
|---|---|---|---|
| Carbon fibers | parts by weight | 25 | 25 |
| Silicone resin | parts by weight | 75 | 75 |
| Thermal conductivity | W/(m · K) | 5.6 | 4.8 |

EFFECT OF THE INVENTION

The carbon fibers of the present invention have an excellent thermal conductivity and can be used in a radiating member. The carbon fibers of the present invention have a high thermal conductivity and readily form a network in a matrix.

The carbon fibers which are free from nonuniformity in fiber diameter can be manufactured by the method of manufacturing carbon fibers of the present invention. Further, the molded product of the present invention has a high conductivity because a network of carbon fibers is formed in the matrix at a high density.

INDUSTRIAL APPLICABILITY

The carbon fibers of the present invention can be used in a radiating member for heat generating electronic parts.

The invention claimed is:

1. Pitch-based carbon fibers which are obtained from mesophase pitch and have an average fiber diameter (AD) of 5 to 20 μm, a percentage ($CV^{AD}$ value) of the degree of filament diameter distribution to average fiber diameter (AD) of 5 to 15, a number average fiber length (NAL) of 100 to 500 μm, a volume average fiber length (VAL) of 55 to 750 μm, a value obtained by dividing the volume average fiber length (VAL) by the number average fiber length (NAL) of 1.02 to 1.50 and a percentage of carbon fibers remaining on a mesh sieve having an opening size of 53 μm when classified with the sieve of 30 to 60% and a ratio of carbon fibers remaining on a mesh sieve having an opening size of 100 μm when classified with the sieve of 10 to 29%.

2. The carbon fibers according to claim 1 which have a crystallite size derived from the hexagonal net plane growth direction of not less than 5 nm.

3. The carbon fibers according to claim 1 which have a true density of 1.5 to 2.3 g/cc and a thermal conductivity in the fiber axis direction of not less than 300W/(m ·K).

4. A molded product comprising the carbon fibers of claim 1.

5. A molded product which comprises the carbon fibers of claim 1 and a matrix and has a carbon fiber content of 10 to 70 parts by weight based on 100 parts by weight of the molded product.

6. The molded product according to claim 5, wherein the matrix is at least one selected from the group consisting of polyolefin-based resins, polyester-based resins, polycarbonate-based resins, polyamide-based resins, polyimide-based resins, polyphenylene sulfide-based resins, polysulfone-based resins, polyether sulfone-based resins, polyether ketone-based resins, polyether ether ketone-based resins, epoxy-based resins, acrylic resins, phenol-based resins and silicone-based resins.

7. The molded product according to claim 5 which is a radiating member.

8. A method of manufacturing the pitch-based carbon fibers of claim 1 characterized by spinning molten mesophase pitch by a melt blow method, stabilizing, baking and milling it, wherein the viscosity of the molten mesophase pitch at the time of spinning is 5 to 25 Pa ·s.

9. The manufacturing method according to claim 8 further comprising graphitization at 2,300 to 3,100° C. after milling.

10. The manufacturing method according to claim 8 further comprising classification after milling.

11. A method of improving the thermal conductivity of a radiating member comprising carbon fibers and a matrix, wherein pitch-based carbon fibers obtained from mesophase pitch and having an average fiber diameter (AD) of 5 to 20 μm, a percentage ($CV^{AD}$ value) of the degree of filament diameter distribution to average fiber diameter (AD) of 5 to 15, a number average fiber length (NAL) of 25 to 500 μm, a volume average fiber length (VAL) of 55 to 750 μm and a value obtained by dividing the volume average fiber length (VAL) by the number average fiber length (NAL) of 1.02 to 1.50 are used as the carbon fibers.

12. A molded product comprising the carbon fibers of claim 2.

13. A molded product comprising the carbon fibers of claim 3.

14. A molded product which comprises the carbon fibers of claim 2 and a matrix and has a carbon fiber content of 10 to 70 parts by weight based on 100 parts by weight of the molded product.

15. A molded product which comprises the carbon fibers of claim 3 and a matrix and has a carbon fiber content of 10 to 70 parts by weight based on 100 parts by weight of the molded product.

* * * * *